US006688562B1

(12) United States Patent
Harvey

(10) Patent No.: US 6,688,562 B1
(45) Date of Patent: Feb. 10, 2004

(54) SUPPORT FOR HOLDING OPEN A BAG

(75) Inventor: Peter Kevin Harvey, Suffolk (GB)

(73) Assignee: Handy Hoop Limited (GB)

( * ) Notice: Subject to any disclaimer, the term of this patent is extended or adjusted under 35 U.S.C. 154(b) by 0 days.

(21) Appl. No.: 10/031,946

(22) PCT Filed: Jul. 21, 2000

(86) PCT No.: PCT/GB00/02754

§ 371 (c)(1),
(2), (4) Date: Apr. 29, 2002

(87) PCT Pub. No.: WO01/07343

PCT Pub. Date: Feb. 1, 2001

(30) Foreign Application Priority Data

Jul. 22, 1999 (GB) ..... 9917072

(51) Int. Cl.[7] ..... B65B 67/04
(52) U.S. Cl. ..... 248/99
(58) Field of Search ..... 248/95, 99, 100, 248/101; 220/404

(56) References Cited

U.S. PATENT DOCUMENTS

| | | | | | |
|---|---|---|---|---|---|
| 900,221 | A | * | 10/1908 | Smith | 248/101 |
| 3,733,099 | A | | 5/1973 | Szita | 294/55 |
| 3,796,402 | A | * | 3/1974 | Trotta | 248/101 |
| 3,866,872 | A | * | 2/1975 | Burgess | 248/101 |
| 3,998,415 | A | | 12/1976 | D'Antonio et al. | 248/101 |
| 4,548,372 | A | | 10/1985 | Lutzker | 248/99 |
| 4,759,518 | A | | 7/1988 | Yardas | 248/97 |
| 5,611,507 | A | | 3/1997 | Smith | 248/99 |
| 6,199,802 | B1 | * | 3/2001 | Scheibe, Sr. | 248/101 |
| 6,386,606 | B1 | * | 5/2002 | Marshall | 15/257.4 |

FOREIGN PATENT DOCUMENTS

| | | |
|---|---|---|
| DE | 805622 | 3/1951 |
| DE | 9204383 | 7/1992 |
| EP | 0908389 | 4/1999 |
| GB | 2330124 | 4/1999 |

OTHER PUBLICATIONS

British Patent Office Search Report; Oct. 1, 1999.
International Search Report; Oct. 5, 2000.

* cited by examiner

*Primary Examiner*—Ramon O. Ramirez
(74) *Attorney, Agent, or Firm*—Bourque & Associates, PA

(57) ABSTRACT

The invention relates to a support for holding open a bag, in particular a plastic material rubbish bag. The support comprises a hoop and a plurality of clips spaced equidistantly around the hoop. The hoop defines an opening through which the open bag may be inserted with the opening of the bag being clipped to the clips. The hoop thereby supports the bag so that the bag hangs through the opening when the hoop is raised. The hoop has a circular cross-section, with each clip being spring-biased to conform to the hoop, so that the bag is pinched between the clip and the hoop. When the bag hangs from the support, the weight of the bag bears on each clip to pinch the bag tighter in each clip.

11 Claims, 3 Drawing Sheets

SUPPORT FOR HOLDING OPEN A BAG

TECHNICAL FIELD

The invention relates to a support for holding open a bag, in particular a plastic material rubbish bag.

BACKGROUND INFORMATION

It can be difficult to hold open a bag with one hand while loading a bag with the other. This is particularly the case with the most common type of bags, which are made from lightweight plastic material. The problem is that when a bag is held at one point from its opening, the weight of the bag tends to pull down the side of the opening away from the person's hand to close off the opening.

The problem of loading a bag held by one hand is exacerbated outside if there is any wind, which will then make the bag move or flap about. Once the bag is partially loaded, the weight from the load inside the bag can pull the opening tightly closed.

One way to deal with this problem is to place the bag on the ground so that it is supported from underneath, and then arrange the opening to be wide open. Again, if the bag is outside and there is any wind, the opening can be blown closed. If the person using the bag has to move around, then it is inconvenient to keep placing the bag on the ground.

One bag support is described in patent document DE G 9204383.6. This discloses a bag support having a supporting frame through which an open bag is inserted. The open edge of the bag is draped over the frame and then secured to the frame by removable spring clips. The spring clips are clipped over the bag where this is draped over the frame. The spring clips have a central inwardly projecting stud which pierces the bag to secure the bag to the frame.

SUMMARY

It is an object of the invention to provide a bag support which is convenient to use and which addresses these issues.

Accordingly, the invention provides a support for holding open a bag, comprising a hoop and a plurality of clips around the hoop, the hoop defining an opening through which an open bag may be inserted with the opening of the bag being clipped to the clips, the hoop thereby supporting the bag so that the bag hangs from the hoop opening when the hoop is raised, in which: the hoop has an outer surface with a convexly curved portion and each clip is permanently held to the hoop with a free portion of the clip that has a spring-biased shape that conforms with said convex surface over an arc of at least about 90°, each clip terminating at a free end that may be pulled away from the convex surface to allow a bag opening to the inserted between the clip and the hoop.

In one preferred embodiment of the invention, the convexly curved portion faces away from the hoop opening, and in another preferred embodiment of the invention, the convexly curved portion faces in towards the hoop opening.

With either embodiment, when a bag opening is clipped to the hoop, it can be arranged to hang over both the bag support and the clips. The forces between the bag and the hoop, due both to the spring bias of the clip and any weight carried by the bag, will help press the bag opening in towards the convex surface in order to retain the bag opening to the hoop.

A person may then insert the open bag either through the hoop opening, or around the outside of the hoop, and then removably affix the bag to the hoop by means of the clips. To maximise the usable volume of the bag, the bag should affix to the clips near edges of the bag opening. The person may then grasp the hoop with one hand and raise the assembly so that the hoop supports the bag and keeps the bag open. When the bag is loaded, then the bag may be removed from the hoop by unclipping the clips from the bag.

The convex curved surface preferably extends fully around the hoop to provide a smooth contour over which the bag opening is draped. When the bag becomes heavily loaded, such a smooth contour spreads forces from the weight of the load to provide a gentle support. Thus even a relatively thin plastic material bag, such as a large black rubbish bag, can be supported without tearing the bag.

The convex surface may advantageously extend substantially fully around a cross-section through the hoop, for example having a substantially circular cross-section. This can provide a comfortable profile for a person to grip.

Because the clips are shaped and spring-biased to conform to the convex surface, the bag is held to the hoop by the pressure exerted between the clip and the hoop. In this sense, the body of the hoop forms one side of the clip holding the bag. Advantages of this arrangement are the simple mechanical construction of the clip, together with the extended area over which pressure is exerted in the clip on the bag. This helps spread the load on the clip, thereby reducing wear and tear on the clip, as well as reducing the risk that weight on the bag will either dislodge the bag from the clip or tear the bag at the clip.

The convex surface and the clips extend over an arc of at least about 90°, and preferably up to about 270°.

To aid insertion of the bag between the clip and the curved surface of the hoop, the clips may have a lip that rises from the surface of the hoop.

The clips may be held to the hoop by rivets or screws, but it is preferred if the clip is integral with the hoop. For example, if the clip and hoop are made from thermoplastic material, then the clip may be joined integrally with the hoop by heat or ultrasonic welding.

In order to support the bag with an opening with as large an area as possible, the hoop may be circular. Since the bag support is then circularly symmetric, the user may hold the hoop at any point along the circumference of the hoop.

Preferably, there are at least three clips around the hoop so that the bag is supported substantially fully around the hoop. So that the user does not have to clip the bag to too many clips, it is also preferred if there are no more than eight clips around the hoop.

To support the bag evenly on the hoop, the clips should be spaced equidistantly around the hoop.

BRIEF DESCRIPTION OF THE DRAWINGS

The invention will now be described by way of example, with reference to the accompanying drawings, in which.

DETAILED DESCRIPTION OF THE PREFERRED EMBODIMENT

Figure 1:
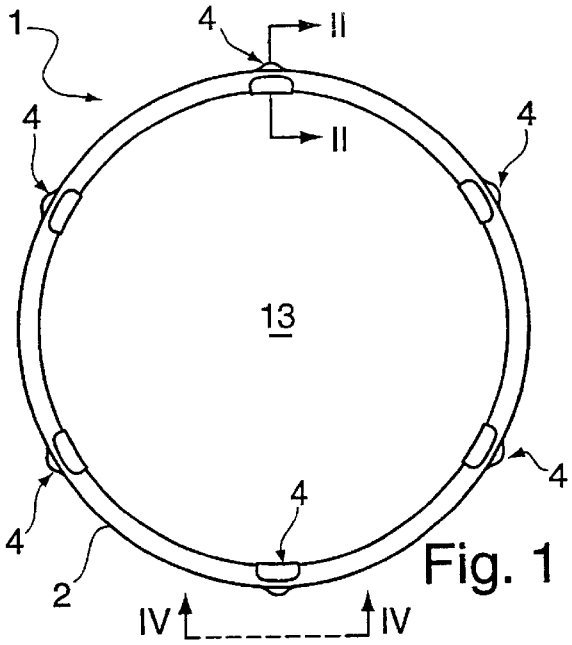
FIG. 1 is a top plan view of a bag support according to a first embodiment of the invention, comprising a hoop and a plurality of clips, before a bag is clipped to the support.
Figure 6:
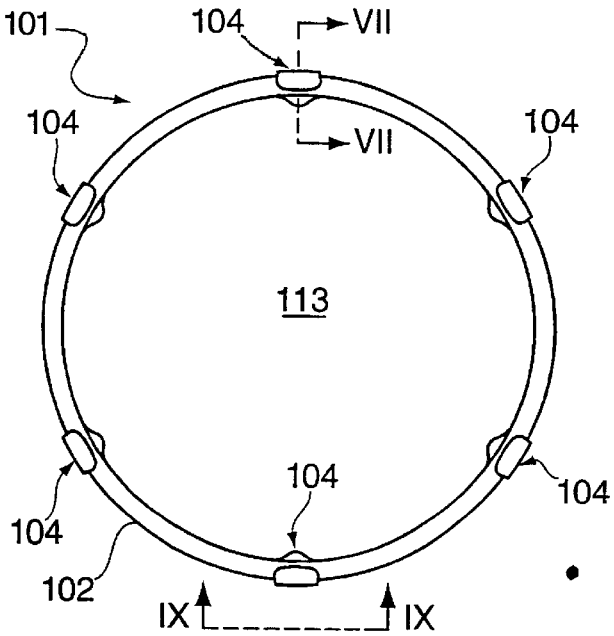
FIGS. 6 to 10 are views similar to those respectively of FIGS. 1 to 5, of a bag support according to a second embodiment of the invention.

FIGS. 1 and 6 show, respectively, a bag support 1,101 according to a first and a second embodiment of the invention. Features of the bag support according to the second embodiment similar to those of the first embodiment are indicated by similar reference numerals incremented by 100. The construction and use of each embodiment is similar, and so will mainly be described together.

The bag support comprising a hoop 2,102 which extends around a full circular loop, and six clips 4,104, which are spaced equidistantly around the circular periphery of the hoop 2,102. The hoop 2,102 is a unitary moulding in a suitable plastics material, such as PVC or polypropylene. The enclosed circular shape of the hoop defines an opening 13,113 through the hoop 2,102.

Figure 2:
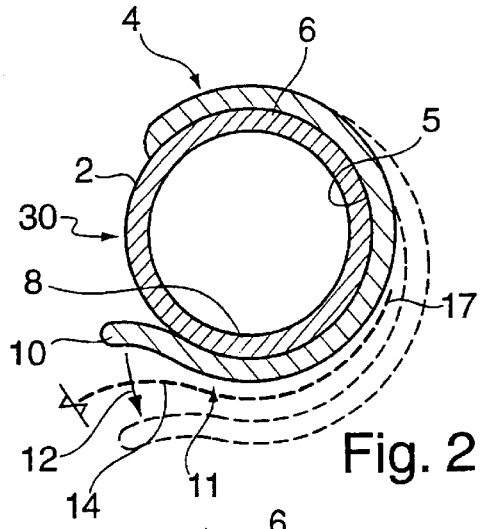
FIG. 2 is a cross-section through one of the clips and the hoop, taken along line II—II of FIG. 1.

As shown in FIGS. 2 and 6, the hoop 2,102 may be hollow in order to reduce its weight and manufacturing cost.

Each of the clips 4,104 is identical. FIGS. 2, 3 and 4 and FIGS. 7, 8 and 9 show the construction and operation of each of the clips 4,104 in more detail. The support 1,101 has a cross-section 30,130 with generally circular profile, with a convexly curved surface 5,105. In the first embodiment of the support 1, the convex surface 5 is on the portion of the hoop facing away from the hoop opening 13,113, and in the second embodiment of the support 101, the convex surface 105 is on the portion of the hoop facing in towards the hoop opening 113.

The clip 4,104 extends around the hoop in an essentially rectangular band over about 210° between an upper portion 6,106 of the hoop at which the clip 4,104 is permanently held to the hoop 2,102, and a lower portion 8,108 of the hoop at which the clip 4,104 has a free end 10,110. The clip 4,104 is formed in a similar material to the hoop 2,102, so that the clip 4,104 and the hoop 2,102 may be heat or ultrasonically welded or glued together at the upper portion 6,106 of the hoop so that the clip 4,104 and hoop 2,102 are integral with each other.

The clip 4,104 is formed initially with a radius of curvature smaller than that of the hoop 2,102, so that when the clip 4,104 is permanently affixed to the hoop 2,102, the clip is elastically deformed to the hoop's radius of curvature. The clip 4,104 is thereby spring-biased to conform closely to the curved surface 5,105 of the hoop 2,102.

The clip free end 10,110 is lip-shaped to depart from the surface of the hoop 2,102. A person may then readily press or pull the clip free end 10,110 down, as shown by arrow 12,112, in order to elastically deform open the clip 2,102, as drawn in phantom in FIGS. 2 and 7. This provides an opening 11,111 in the clip 4,104.

Figure 5:
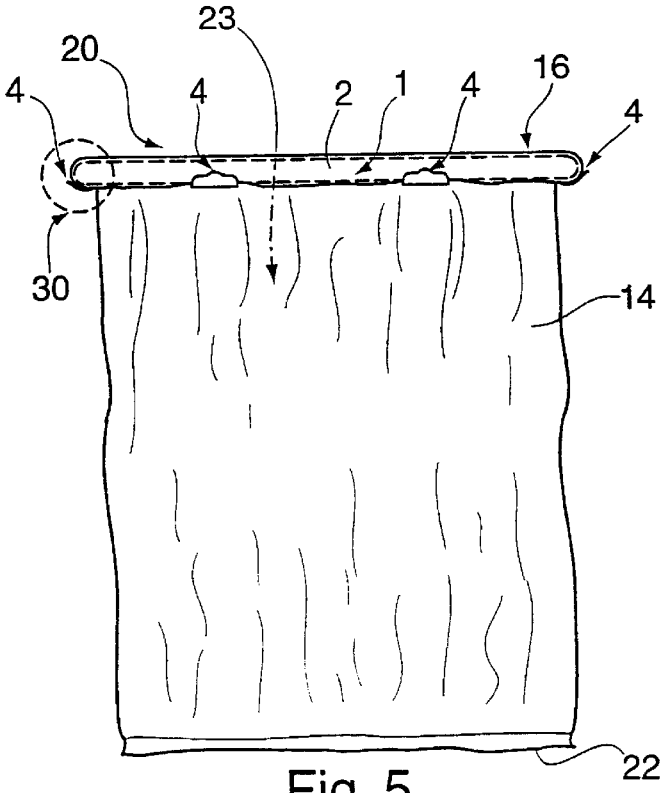
FIG. 5 is a side view of a bag support assembly, comprising the bag support of FIG. 1 with a bag clipped to the hoop.
Figure 4:
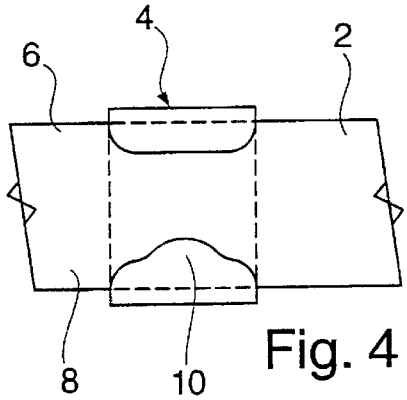
FIG. 4 is a side view of a clip, taken along line IV—IV of FIG. 1.
Figure 10:
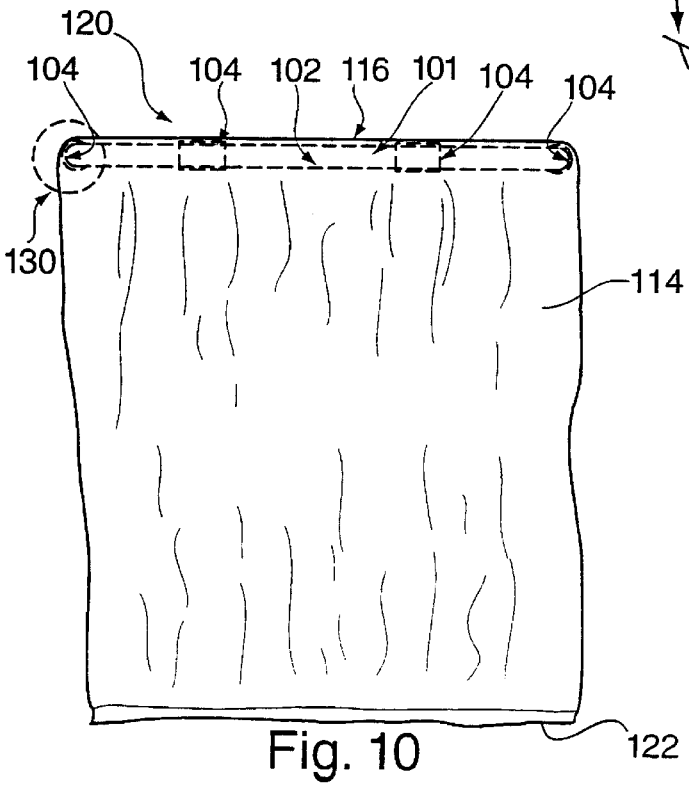
Figure 9:
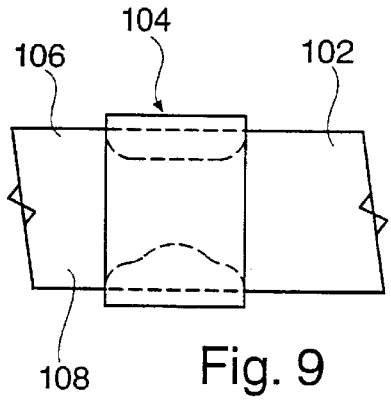

FIGS. 5 and 10 shows respectively first and second embodiments of a bag support assembly 20,120, comprising a plastic refuse bag 14,114 with a bag opening 16,116 removably affixed to the hoop 2,102. The bag opening 16,116 has an edge 17,117 that has been inserted into the clip opening 11,111 to affix the bag 14,114 removably to the hoop 2,102. The bag 14,114 is clipped to the hoop 2,102 in the following manner. First the bag 14,114 is opened up and placed through the hoop opening 13,113, with the bag opening edge 17,117 adjacent the hoop 2,102. The user then pulls open 12,112 in turn each clip free end 10,110, and guides the bag opening edge 17,117 so that this enters the opening 11,111 in the clip 4,104. The bag opening edge 17,117 may then be inserted as far as the clip 4,104 is opened. When the free end 10,110 of the clip 4,104 is released, this springs back against the bag opening edge 17,117 and the hoop 2,102 to press the bag opening 16,116 in towards the convex outer surface of the hoop 2,102. The clip 4,104 and the hoop 2,102 therefore co-operate to pinch the open edge 17,117 of bag. The bag opening 16,116 is thereby gripped and retained to the hoop 2,102. Once the bag opening edge 17,117 has been clipped by all six clips 4,104, the bag 14,114 will be supported by the hoop 2,102.

Figure 3:
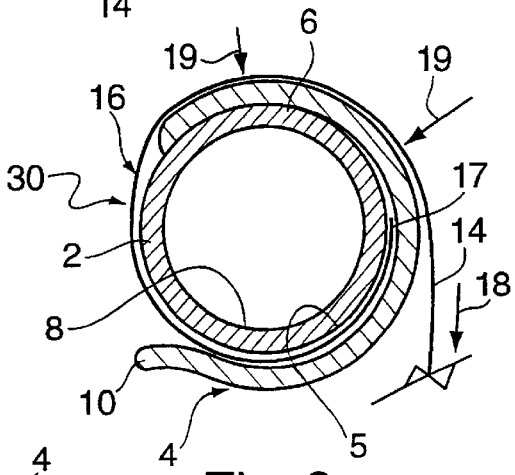
FIG. 3 is a cross-section similar to FIG. 2, showing how a clip is opened to receive an open edge of a bag.

As illustrated in FIG. 3, when the bag is loaded so that weight 18,118 bears down on the bag 14,114 and hoop 2,102, the weight 18,118 will be borne by the hoop along the upwardly curving portion 6,106 of the hoop, where the bag loops over bag support 1. The forces between the bag support 1,101 and hoop 2,102 will be substantially or essentially normal to the convex outer surfaces of the hoop 2,102 and clip 4,104, where these contact the bag 14,114, as indicated by arrows 19,119 in FIGS. 3 and 8. These forces 19,119, tend to compress the clip more securely against the hoop, particularly on the hoop convex surface 5,105. Therefore, as the bag 14,114 is loaded, it becomes ever more securely pinched between the clip 4,104 and the hoop 2,102.

When the bag 14,114 is to be removed from the bag support 1,101, then the weight of the bag may be relieved from the bag support, for example by placing the base 22,122 of the bag on the ground. Each clip 4,104 may then in turn be opened up so that the opening 16,116 of the bag 14,114 can be disengaged from the clip 4,104.

If the hoop 2,102 is to be used to support a large black plastic rubbish bag, then the hoop should be about 250 mm to 450 mm in diameter. The cross-section of the hoop 2,102 should be between about 25 mm and 45 mm, and most preferably 35 mm to provide strength and a secure and comfortable grip to the user, whilst at the same time keeping the material and hence manufacturing cost of the hoop 2,102 to a minimum.

Optionally, the hoop 2,102 and/or the clips 4,104 may be roughened, for example with cross-hatching (not shown) to improve grip on the bag 14,114. Additionally or alternatively, the hoop 2,102 and/or the clips 4,104 may have an elastomeric surface, or other such relatively high friction surface, to improve grip on the bag 14,114.

The hoop 2,102 need not be circular. In some circumstances, it may be desirable for the hoop to have an oval or an elliptical circumference (not shown). This will reduce the open area of the bag opening 16,116, but this may not be a problem when the bag support is to be used to collect smaller objects. This arrangement may provide advantages in that wind will not so easily enter the bag, which could be a problem if the bag contains lightweight objects, such a scraps of paper that could be blown out of the bag. If such a non-circular hoop were held at a point along a longer side of the hoop, then the centre of gravity of the bag support assembly would tend to be closer to a line directly under the supporting hand. This would tend to reduce any twisting forces between the hand and hoop when the bag was heavily loaded.

An advantage of the first embodiment 1, as compared with the second embodiment 101, is that it has been found to be easier to affix and remove the bag 14 to the clips 4 when the clip openings 11 face outwards from the bag 14. An advantage of the second embodiment 101, as compared with the first embodiment 1, is that the clips 104 are more concealed and less likely to be inadvertently opened, for example if the support 101 is pulled along the ground.

A hoop similar to those described above may be provided with clips 4,104 according to both the first and second embodiments. For example, there may be a total of twelve such clips of alternating embodiments equally spaced around a circular hoop. The user use of the support may then choose between having the bag affixed to the hoop with the bag opening either inside or outside the hoop opening.

Figure 7:
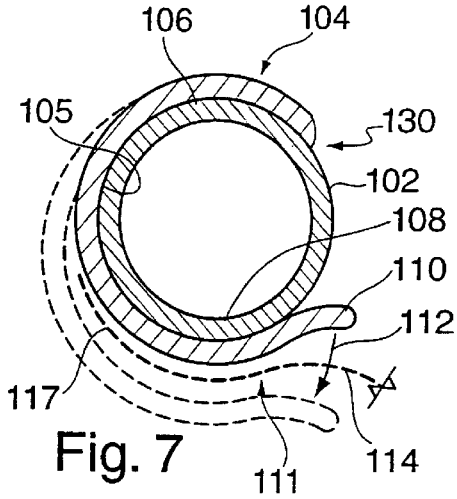
Figure 8:
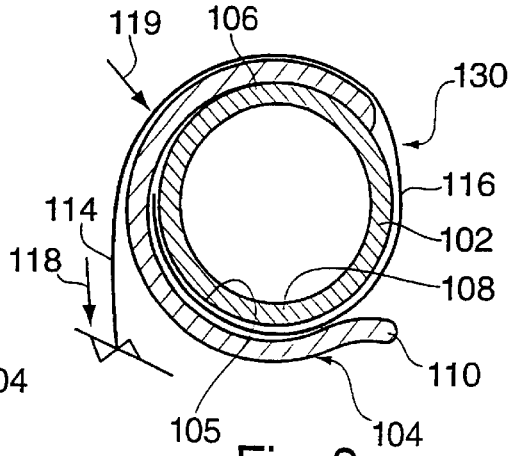
Figure 11:
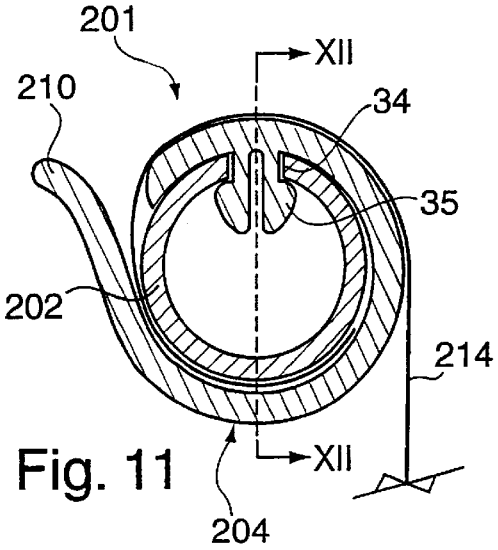
FIG. 11 is a cross-section through a bag support according to a third embodiment of the invention.
Figure 12:
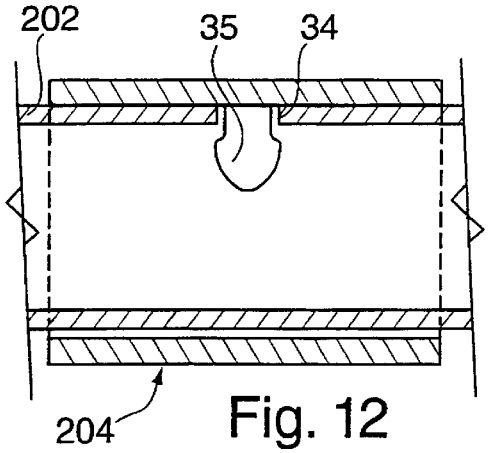
FIG. 12 is a cross-sectional view through the bag support of FIG. 11, taken along the line XII—XII.

FIG. 11 shows a cross section similar to that of FIG. 7 or 8, through a bag support 201 according to a third embodiment of the invention. This bag support 201 has a hollow hoop 202 with six similar holes 34 spaced equidistantly around the circumference of the hoop 202. Each of six clips 204 is essentially cylindrical and has an outwardly flared and split stud 35 that projects downwardly and inwardly so that each clip 204 can be permanently affixed to the hoop 202 by press-fitting the stud through the hole 35. FIG. 12 shows how this holds the clip 204 closely to the hoop 202 near the stud 35. A free end 210 of the clip 204 can then be pressed as described above to open up the clip 204 and allow a bag 214 to be engaged with the clip 204. Compared with the embodiments described above, the clip 204 extends close to 360° around the cross-sectional circumference of the hoop 202, which helps provide greater grip of the bag 214 between the clip 204 and the hoop 202. The clip free end 210 is also larger than the free end of the previously described embodiments, which facilitates the opening of the clip 204.

Figure 13:
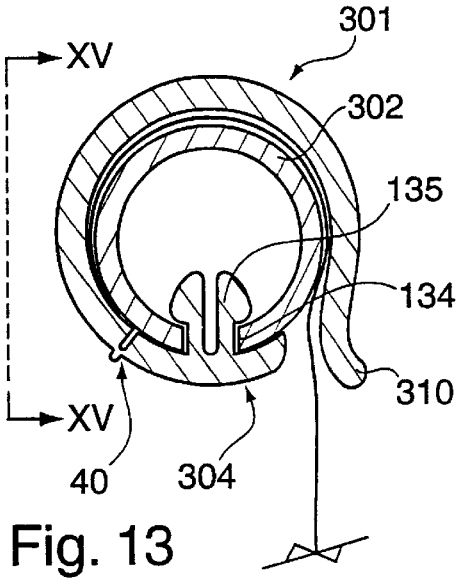
FIGS. 13 and 14 are cross-sectional views respectively through bag supports according to a fourth and a fifth embodiment of the invention.
Figure 15:
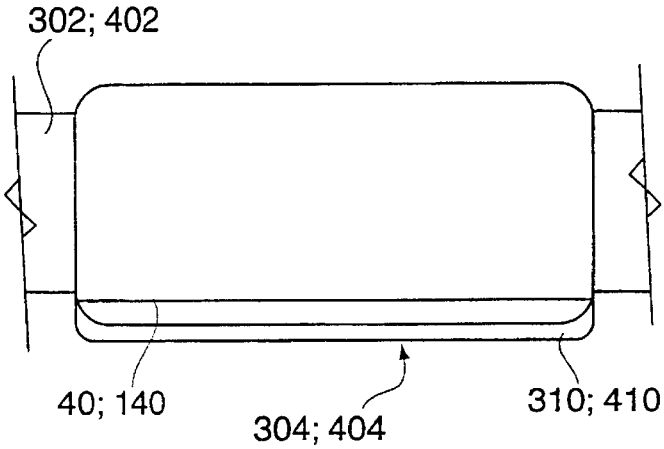
FIG. 15 is a side view of either of the bag supports of FIG. 13 or 14, taken along line XV—XV.

FIG. 13 shows a cross section similar to that of FIG. 11, through a bag support 301 according to a fourth embodiment of the invention. This differs from the embodiment of FIG. 11 in two ways. First, an outwardly flared and split stud 135 that projects upwardly and inwardly into the hollow hoop 302 so that each clip 304 can be permanently affixed to the hoop 302 by press-fitting the stud through a matching hole 135. Second, the clip 304 has a portion that is thin relative to the rest of the clip which forms a hinge 40 to permit the clip 304 to open fully. As can be seen in FIG. 15, the hinge 40 runs the length of the clip 304 parallel to the plane of the hoop 302. Although the clip 304 is hinged, and therefore free to pivot open fully away from the hinge, the clip still grips a bag securely when closed. This is because the clip 304 when closed extends more than 180° around the cross-sectional circumference of the hoop 302, and because the clip is formed with a curvature with a radius less than that of the cross-sectional radius of the hoop 302. The clip is therefore spring biased when closed to hold the bag securely.

Figure 14:
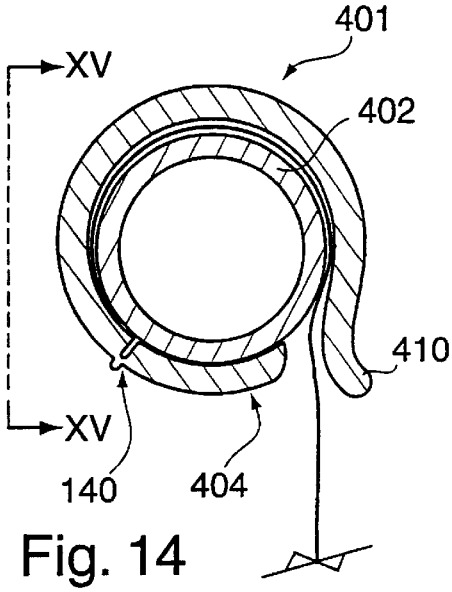

FIG. 14 shows a cross section similar to that of FIG. 11, through a bag support 401 according to a fifth embodiment of the invention. This is the same as the bag support 301 with hinged clips 304 described above, with the exception that each clip 404 is glued, heat or ultrasonically welded, or otherwise permanently affixed to an unbroken outer surface of the hoop 402.

Because the hinged clips 304,404 each open fully by bending back from the respective hinge 40,140, it is easier to insert a bag fully between the clip and the hoop 302,402.

The embodiments shown in FIGS. 13 and 14 may be used inverted, that is with the free ends 310,410 extending upwards. In this case, the bag will extend around the outer surface of the hoop and over the hinges 40,140.

Bag supports such as those described above are convenient to use and are effective in keeping a bag open as it is being loaded. The bag may be quickly affixed to the support by the clips, and also quickly disengaged from the clips.

It is to be recognized that various alterations, modifications, and/or additions may be introduced into the constructions and arrangements of parts described above without departing from the spirit or scope of the present invention, as defined by the appended claims.

What is claimed is:

1. A support for holding open a bag, comprising a hoop and a plurality of clips around the hoop, the hoop defining an opening through which an open bag may be inserted with the opening of the bag being clipped to the clips, the hoop thereby supporting the bag so that the bag hangs from the hoop opening when the hoop is raised, in which: the hoop has an outer surface with a convexly curved portion and each clip is permanently held to the hoop with a free portion of the clip that has a spring-biased shape that conforms with said convex surface over an arc of at least about 90°, each clip terminating at a free end that may be pulled away from the convex surface to allow a bag opening to the inserted between the clip and the hoop wherein the clip is hinged so that the free end of the clip can be retracted fully from the hoop.

2. A support as claimed in claim 1, in which said convexly curved portion faces away from the hoop opening.

3. A support as claimed in claim 1, in which said convexly curved portion faces in towards the hoop opening.

4. A support as claimed in claim 1, in which the hoop has a substantially circular cross-section.

5. A support as claimed in claim 1, in which forces between the bag opening and the hoop are essentially normal to said convex surface of the hoop and clip where these contact the bag opening in order to retain the bag opening to the hoop.

6. A support as claimed in claim 1, in which the convex surface extends substantially fully around a cross-section through the hoop.

7. A support as claimed in claim 1, in which the surface and the clips extend over an arc of up to about 270°.

8. A support as claimed in claim 1, in which the clips have a lip that rises from the surface of the hoop to aid insertion of the bag between the clip and convex surface of the hoop.

9. A bag support assembly, comprising an open bag and a bag support which supports the bag, in which the bag support comprises a hoop and a plurality of clips around the hoop, the hoop defining an opening through which an open bag may be inserted with the opening of the bag being clipped to the clips, the hoop thereby supporting the bag so that the bag hangs from the hoop opening when the hoop is raised, in which: the hoop has an outer surface with a convexly curved portion and each clip is permanently held to the hoop with a free portion of the clip that has a spring-biased shape that conforms with said convex surface over an arc of at least about 90°, each clip terminating at a free end that may be pulled away from the convex surface to allow a bag opening to the inserted between the clip and the hoop wherein the clip is hinged so that the free end of the clip can be retracted fully from the hoop.

10. A bag support assembly as claimed in claim 9, in which the hoop and/or the clip is roughened to improve grip on the bag.

11. A bag support assembly as claimed in claim 9, in which the hoop and/or the clip has an elastomeric surface to improve grip on the bag.

* * * * *